US006158483A

United States Patent [19]

Trpkovski

[11] Patent Number: 6,158,483

[45] **Date of Patent: *Dec. 12, 2000**

[54] METHOD FOR FILLING INSULATED GLASS UNITS WITH INSULATING GAS

[75] Inventor: Paul Trpkovski, Spring Green, Wis.

[73] Assignee: Cardinal IG Company, Minnetonka, Mass.

[ * ] Notice: This patent is subject to a terminal disclaimer.

[21] Appl. No.: 09/286,349

[22] Filed: Apr. 5, 1999

Related U.S. Application Data

[62] Division of application No. 08/957,532, Oct. 24, 1997, Pat. No. 5,957,532.

[51] Int. Cl.[7] ..... B65B 1/04

[52] U.S. Cl. ..... 141/63; 141/66; 141/129; 156/382; 156/580

[58] Field of Search ..... 141/4, 59, 65, 141/66, 129, 63; 156/382, 580; 198/570, 690.2

[56] References Cited

U.S. PATENT DOCUMENTS

| | | | |
|---|---|---|---|
| 4,247,355 | 1/1981 | Friedrick et al. | 156/580 |
| 4,369,084 | 1/1983 | Lisec | 156/580 |
| 4,780,164 | 10/1988 | Rueckheim et al. . | |
| 5,017,252 | 5/1991 | Aldrich et al. . | |
| 5,366,574 | 11/1994 | Lenhardt et al. | 156/102 |
| 5,413,156 | 5/1995 | Lisec . | |
| 5,476,124 | 12/1995 | Lisec . | |
| 5,573,618 | 11/1996 | Rueckheim . | |
| 5,626,712 | 5/1997 | Lisec . | |
| 5,645,678 | 7/1997 | Lisec | 156/382 |
| 5,676,782 | 10/1997 | Lisec . | |

FOREIGN PATENT DOCUMENTS

| | | |
|---|---|---|
| 0056762 | 7/1982 | European Pat. Off. . |
| 3115566 | 10/1982 | Germany . |
| 3402323 | 8/1985 | Germany . |
| 4315986 | 11/1994 | Germany . |

*Primary Examiner*—Steven O. Douglas
*Attorney, Agent, or Firm*—Fredrikson & Byron, P.A.

[57] ABSTRACT

An apparatus and method for replacing air with an insulating gas during manufacture of an insulated glass article having two parallel panes and a peripheral spacer between the panes. The apparatus includes an upright first platen, a second platen confronting the first platen, a mechanism for moving at least one of the platens toward and away from the other platen, and a peripheral resilient seal positioned to define a sealed enclosure between the platens. The apparatus may further include a conveyer for conveying a partially assembled insulating glass article between the platens, an exhaust mechanism for drawing gas from the enclosure, and an intake mechanism for introducing insulating gas to the enclosure. One method of the invention involves filling such an insulated glass article and measuring the thickness of the article to detect bulging or cupping.

17 Claims, 6 Drawing Sheets

METHOD FOR FILLING INSULATED GLASS UNITS WITH INSULATING GAS

This is a divisional of application Ser. No. 08/957,532, Now U.S. Pat. No. 5,957,532, filed Oct. 24, 1997.

FIELD OF THE INVENTION

This invention relates to an apparatus for assembling insulating glass assemblies which may not have uniform sizes or shapes, and filling the glass assemblies with an insulating gas such as argon.

BACKGROUND OF THE INVENTION.

Insulating glass assemblies for use in the manufacture of windows, doors and the like commonly have two substantially parallel, spaced-apart glass panes spaced apart by a peripheral spacer. Spacers commonly are of metal, usually of tubular configuration, that are formed so as to have two flat, substantially parallel sides facing the confronting surfaces of the panes and bent so as to conform to the periphery of the glass panes. Sealant materials such as polyisobutylene are employed between the flat sides of the spacer and the confronting glass surfaces to seal the glass surfaces to the spacer. To enhance the thermal resistance across the glass assemblies, the interpane space may be filled with an insulating gas such as argon having a thermal conductivity that is less than that of air.

In the manufacture of insulating glass units, uniform production line procedures enable glass assemblies of a single size to be made in large quantities. Custom insulating glass units, on the other hand, are generally manufactured in quantities as small as a single unit, and a single order may require the manufacture of units having varying sizes and shapes.

Various methods and apparatuses have been suggested to enable air within the interpane space to be replaced with an insulating gas such as argon. In one method, the glass panes are adhered to a spacer to form a substantially sealed interpane space, and then air within the space is gradually replaced with argon through an access port. In another method, the interpane space of a multipane glass assembly is filled with an insulating gas by first drawing a vacuum to remove air from the interpane space before both panes are sealed to the spacer, and then charging the evacuated interpane space with an insulating gas. After the interpane space is filled with the insulating gas, the panes are sealed to the spacer.

Various methods and apparatuses for replacing air with an insulating gas in insulating glass units are shown in U.S. Pat. No. 5,017,252, 4,780,164, 5,573,618 (Rueckheim) and 5,476,124 (Lisec). In the last mentioned patent, an apparatus is described in which an insulating glass unit having a pair of glass panes separated by a peripheral spacer is conveyed by a conveyor belt between parallel plates, the bottom edge of the outer glass pane being spaced slightly away from the spacer to provide generally vertical openings along the side edges of the unit. The leading edges of the glass panes are conveyed into contact with a vertical sealing device. Another vertical sealing device is then moved into contact with the trailing edge of the glass panes to seal, with the gas-tight conveyor belt, the space between the glass panes. An insulating gas is then flowed laterally from one vertical sealing device to the other under conditions avoiding turbulence. When the glass unit has been appropriately filled with insulating gas, one plate is advanced toward the other to compress the glass unit between the plates and thus completely adhere the glass panes to the peripheral spacer. This device replaces air with an insulating gas in one glass unit at a time, and due to its employment of non-turbulent gas flow, requires considerable time to replace the air with insulating gas. It would be advantageous to provide a method and apparatus for filling one or a plurality of the same or different size insulating glass units at a time with an insulating gas in a manner providing rapid and substantially complete replacement of air.

SUMMARY OF THE INVENTION

The present invention provides an apparatus for replacing air with an insulating gas during manufacture of an insulated glass unit, the unit having two parallel glass panes and a peripheral spacer between the panes and defining an interpane space. The apparatus comprises an upright first platen and a second platen spaced from and confronting the first platen. Means are provided for moving at least one of the platens toward and away from the other. At least one of the platens, preferably a moveable platen, carries a peripheral, resilient seal that extends toward and is capable of peripherally sealing to the other platen to define a sealed enclosure between the platens. A conveyor is provided within the enclosure for moving a partially assembled insulating glass article into a gas replacement position between the platens. Exhaust means are provided for drawing air and insulating gas from the enclosure, and intake means are provided for introducing a turbulent flow of insulating gas upwardly through the conveyor and into a glass unit supported on the conveyor.

In a preferred embodiment, the conveyor, which is contained within the enclosure defined by the spaced platens and the peripheral, resilient seal, comprises a conveyor belt which is perforated so as to enable insulating gas to be introduced beneath the conveyor and thence upwardly under turbulent flow into the interpane space.

The invention also comprises a method for replacing air with an insulating gas in an insulating glass unit. A partially assembled glass unit is provided having a pair of parallel panes and a peripheral spacer between the panes to define an interpane space. The lower edge of one pane is spaced from the spacer to provide a bottom gap permitting communication with the interpane space. The partially assembled insulated glass unit as thus described is conveyed within an enclosure, and an insulating gas is introduced under turbulent flow conditions upwardly through the gap to turbulently mix with the air. A mixture of insulating gas and air is exhausted from the enclosure until the concentration of insulating gas within the enclosure reaches the desired level. The lower edge of the glass pane is then closed against the spacer to seal the interpane space.

A preferred embodiment of the method comprises conveying between spaced platens having a peripheral seal a partially assembled insulating glass unit having a pair of spaced panes and a peripheral spacer, the lower edge of one pane spaced from the spacer to provide a bottom gap. The method includes the step of bringing the platens toward each other to form, with the peripheral seal, an enclosure with the partially assembled glass unit supported within the enclosure. An insulating gas is introduced under turbulent flow conditions upwardly through the gap to turbulently mix with the air, and a mixture of insulating gas and air is exhausted from the enclosure until the concentration of insulating gas within the enclosure reaches a desired, predetermined level. The platens are then moved closer together to force the lower edge of the one pane into contact with the spacer to close the bottom gap and to seal the panes to the spacer, following which the platens are separated, the completed glass unit is conveyed outwardly from between the platens.

Preferably, the method includes the step of adjusting the pressure of insulating gas within the enclosure to a final pressure slightly below atmospheric pressure before closing the lower edge of the glass pane against the spacer so that, in subsequent processing involving pressing of the glass panes against the spacer, the resultant slight reduction in volume of the interpane space will cause the pressure in that space to rise to approximately equal atmospheric pressure.

DETAILED DESCRIPTION OF THE PREFERRED EMBODIMEMT

Figure 1:
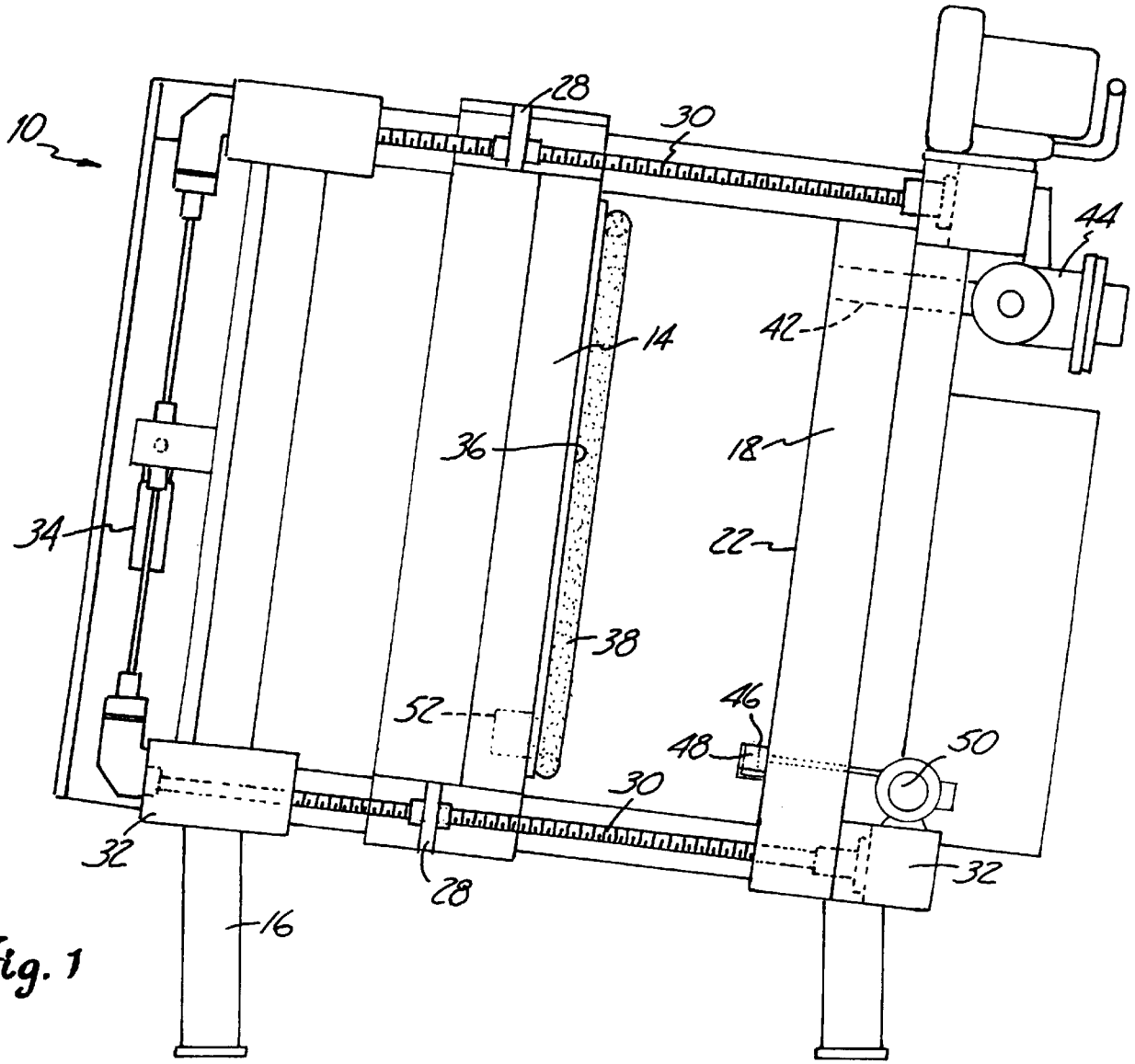
FIG. 1 is a side view of an apparatus of the invention, shown in its open position.

The preferred embodiment of the invention employs a pair of generally parallel platens mounted in a framework and powered so that one of the platens may move toward and away from the other while maintaining parallelism between the platens. Parallelism desirably is accomplished by driving the moveable platen through the use of co-acting screw drives positioned at the corners of the movable platen and powered by a single motor. Although both of the platens may move, it is desirable that one of the platens, referred to for convenience as the first platen, be stationary and that the other, second platen, be movable toward and away from the first platen.

The second platen is provided with a resilient, compressible seal extending about its periphery adjacent the edge of the platen and facing the peripheral edge of the first platen such that when the second platen is moved toward the first platen, the seal engages the first platen to form with the confronting platen surfaces an enclosure within which the replacement of air with argon or other insulating gas may occur.

Near its bottom, but yet within the enclosure, the first platen is provided with a horizontal conveyor for conveying partially assembled insulating glass units into and out of the apparatus. The conveyor preferably comprises a conveyor belt driven by rollers having axles journaled into the first platen and appropriately driven by a power source on the other side of the first platen from the enclosure. In this preferred embodiment, the conveyor belt comprises an endless loop trained about the rollers, and is perforated so as to enable insulating gas to readily pass through it. Directly beneath the top horizontal run of the conveyor belt is an insulating gas manifold having upwardly facing apertures enabling an insulating gas to be forced upwardly through the perforations in the conveyor belt and into the interpane space of an insulating gas unit.

The conveyor may also take the form of, for example, a series of horizontally spaced rollers, at least some of which are driven, and upon which the partially assembled insulating glass unit may travel, spaces between the rollers permitting the upward flow of insulating gas. A conveyor belt is preferred, however, since its use avoids passing glass panes from one roller to another with possible consequent movement of either pane with respect to the other.

As used herein, "partially assembled insulating glass unit" refers to an insulating glass unit comprising a pair of glass panes which are spaced from one another by means of a continuous peripheral spacer extending between the panes, the spacer having generally flat, opposed surfaces facing confronting surfaces of the respective panes and sealable to the panes through the use of a suitable sealant such as a silicone or a polyisobutylene rubber. The spacer is sealed to the surface of the first pane, and the surface of the spacer that confronts the second of the two panes is provided with a sealant to which the confronting surface of the second pane may adhere when the second pane is pressed against the spacer. The upper edge of the second pane is adhered to the spacer, but the bottom edge of the second pane is spaced slightly from the spacer so as to provide a bottom gap defined by the confronting surface of the second glass pane at its lower edge and the peripheral spacer. The partially assembled glass unit thus has an inverted V configuration.

The partially assembled insulating glass unit as thus described may be manually fabricated in a generally upright position at an assembly station with the first pane laid back slightly against a surface provided with rollers to enable the pane to be conveyed easily and with the bottom edge of each of the glass panes supported on a conveyor that is aligned with the conveyor belt of the apparatus of the invention. With the platens spaced apart, the partially assembled insulating glass unit is moved onto the conveyor of the apparatus which itself moves the glass unit to an appropriate location between the platens. The bottom edges of the glass panes are supported against the upper surface of the conveyor belt. So as to harmonize with the remainder of the manufacturing process, as will be described in greater detail below, it is desired that the rear surface of the first pane be supported by the confronting surface of the first platen, although the unit could be reversed if desired. The surface of the first platen contains a plurality of perforations to which air under pressure is supplied to create a cushion of air upon which the first pane may slide as the glass unit is conveyed into and out of the apparatus.

The second platen is then moved toward the first platen to enable the peripheral, resilient seal carried by the second platen to seal against the first platen and to establish an enclosure between the platens. The conveyor belt that supports the bottom edges of the glass panes is itself included within the enclosure, and the second platen may be appropriately recessed near the bottom of the enclosure to accommodate the conveyor belt as the second platen closes upon the first. Desirably, the second platen at this stage in the process contacts the second glass pane at or near its edge and may move the bottom edge of the second pane slightly toward the spacer so as to provide a predetermined gap width between the spacer and the confronting surface of the second glass pane at its bottom.

A partial vacuum is quickly drawn within the enclosure, desirably to a gauge pressure of minus several psi, e.g., minus about two psi (that is, to an actual pressure within the enclosure of about 12.7 psi), although the vacuum that is drawn may be substantially greater than this if desired. If a greater vacuum is desired, the apparatus may utilize a separate vacuum tank of substantial volume in which a vacuum is drawn and which is opened to the interior of the enclosure to rapidly lower the pressure in the enclosure. However, if a vacuum of only several psi is desired, the apparatus may simply utilize an air blower to exhaust air from the enclosure through an exhaust duct, and air may also be drawn from the enclosure by drawing air through the perforations formed in the first platen.

Once the pressure in the enclosure has quickly been reduced by the desired amount, e.g., for illustration, by about two psi utilizing an exhaust blower with a damper, the damper is closed and argon gas is jetted upwardly through perforations in the conveyor belt into the bottom gap in the partially assembled glass unit, the argon flowing upwardly within the interpane space in turbulent flow and mixing with air in the interpane space. Pressure in the enclosure accordingly rises. When the enclosure pressure has risen slightly above atmospheric pressure, e.g., to about two psi gauge pressure, the damper is again opened to exhaust the argon/air mixture in the enclosure. The flow rates of entering argon and air/argon exhaust may be adjusted so as to maintain a slightly positive pressure in the enclosure. A simpler system involves continuously flowing argon into the enclosure, as described, while intermittently opening the exhaust damper to cause the pressure in the enclosure to cycle in a narrow range, e.g., between 0.5 psi and 2.0 psi. As the cycle proceeds, the concentration of argon within the enclosure increases. When the appropriate argon concentration is reached, e.g., about 97% argon by volume, the flow of gas into and out of the enclosure is regulated so as to desirably provide a slightly subatmospheric pressure within the enclosure. At this point, the second platen is moved further toward the first platen, causing the bottom gap between the spacer and confronting glass surface to close and completing the seal between the second pane and the spacer. Air is admitted to the enclosure, either through appropriate duct work or through the above described perforations or both, and the second platen is moved away from the first platen a sufficient distance to enable the conveyor belt to convey the sealed insulating glass unit outwardly from between the platens to another stage in the manufacturing process.

From the above description, it will be understood that the surface of the conveyor upon which the lower edges of the glass panes rest must on the one hand grip the bottom surfaces strongly enough so that the bottom gap between the panes does not inadvertently and prematurely close, but yet must enable the bottom edge of one of the glass panes to slide easily into contact with the spacer when this is desired. To accomplish this, the conveyor belt or rollers may have smooth surfaces, but also may have appropriate downwardly extending shallow grooves in them to prevent inadvertent movement of the glass panes.

From the apparatus described above, the sealed insulating glass unit in its substantially upright position may be repositioned to a horizontal position and conveyed between the platens of a press in a subsequent manufacturing station, the glass panes being pressed toward one another by a sufficient amount so as to render uniform the thickness of the sealant about the periphery of the spacer and to bring the thickness of the entire glass unit and its periphery within desired tolerances. The very slight reduction in thickness that this step accomplishes decreases the interpane volume slightly and, consequently, increases the pressure of insulating gas within the interpane space, desirably bringing that pressure up to atmospheric pressure.

From the pressing station thus described, the insulating glass unit travels beneath a thickness measuring device which measures the thickness of the glass unit across the width of the glass unit in the direction of travel as the glass unit moves past the measuring device. Thickness variances that exceed tolerable limits are signaled, e.g., by an audible tone. If the glass unit is found to have either a slight bulge in its center, indicating that the pressure in the interpane space is slightly greater than atmospheric, or a cupped configuration, indicating that the interpane space pressure is slightly less than atmospheric, adjustments may be made to the gas filling unit to reduce or increase the final pressure of argon within the interpane space at the end of the gas filling cycle. If desired, signals representing measured discrepancies in thickness may be employed to automatically adjust the final pressure in the gas filling apparatus. However, it has been found that the necessary sub-atmospheric final pressures in the gas filling enclosure can be empirically determined quite closely for different sizes of glass units. As a result, bulging of glass units is very rarely a problem. Cupping of a glass unit, also rarely a problem, commonly signals that the glass panes were not completely sealed to the spacer walls.

Following the thickness measuring step, the glass unit is conveyed to other manufacturing stations where, for example, additional sealant may be applied.

It will be understood that the glass units, from the point of their partial assembly just "upstream" from the gas exchange apparatus to the point of thickness measurement, are conveyed intermittently along the manufacturing line. Partial assembly may be a manual task in which one or more, commonly two or three or more, partially assembled glass units are provided on a conveyor belt with suitable spacing between them. Activation of the conveyor belt conveys the glass units as a batch onto the conveyor belt of the gas filling apparatus and thence into the apparatus between the platens, whereupon movement along the manufacturing line again halts during the gas exchange operation. Upon opening of the platens, the conveyor belt again is activated, moving the glass units as a batch onto a sequential series of aligned conveyors that convey the glass units to other manufacturing stations. In the course of their fabrication, the glass units are conveyed from one manufacturing station to another, and in many of these stations, the glass units are momentarily halted while a manufacturing operation is performed. In the gas exchange apparatus and in the pressing apparatus, the several glass units in a batch are concurrently subjected to the same manufacturing conditions. In the thickness measuring station, thickness is measured of one unit at a time, and this is done while the glass units are moving.

Figure 2:
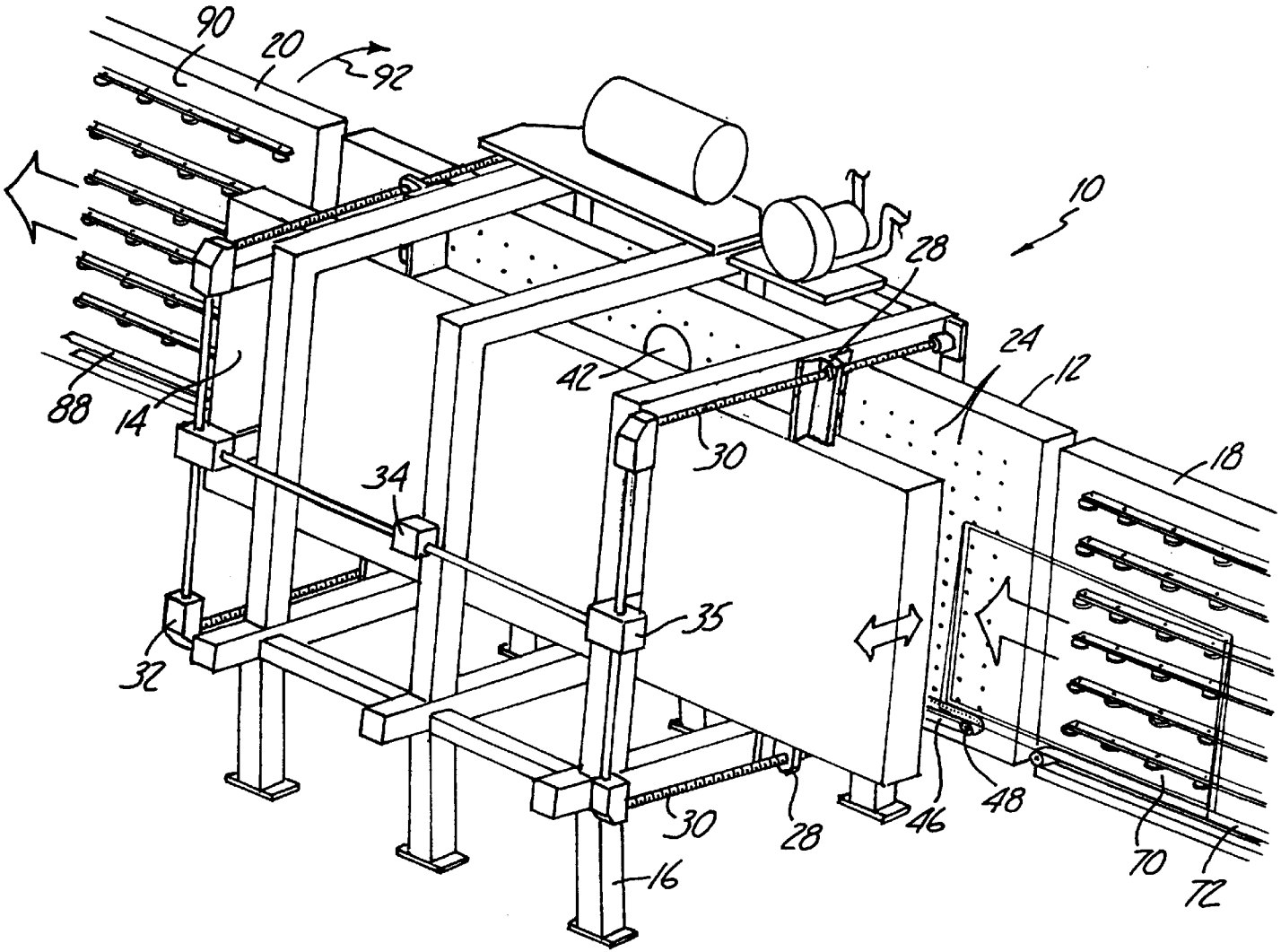
FIG. 2 is a perspective view of the apparatus of FIG. 1, illustrating a step in a method of the invention.

Referring now to FIG. 2, a gas filling device is shown generally as 10, and includes spaced, parallel, generally upright platens 12, 14 each supported by a rigid, ground-mounted framework 16. The apparatus 10 of the invention is part of a manufacturing line which includes a manual fabrication station 18 just upstream from the apparatus 10 and at which the partially assembled insulating glass units are manually fabricated, and a take away station 20 just downstream from the apparatus 10 to receive the sealed glass units from the apparatus 10.

Figure 4:
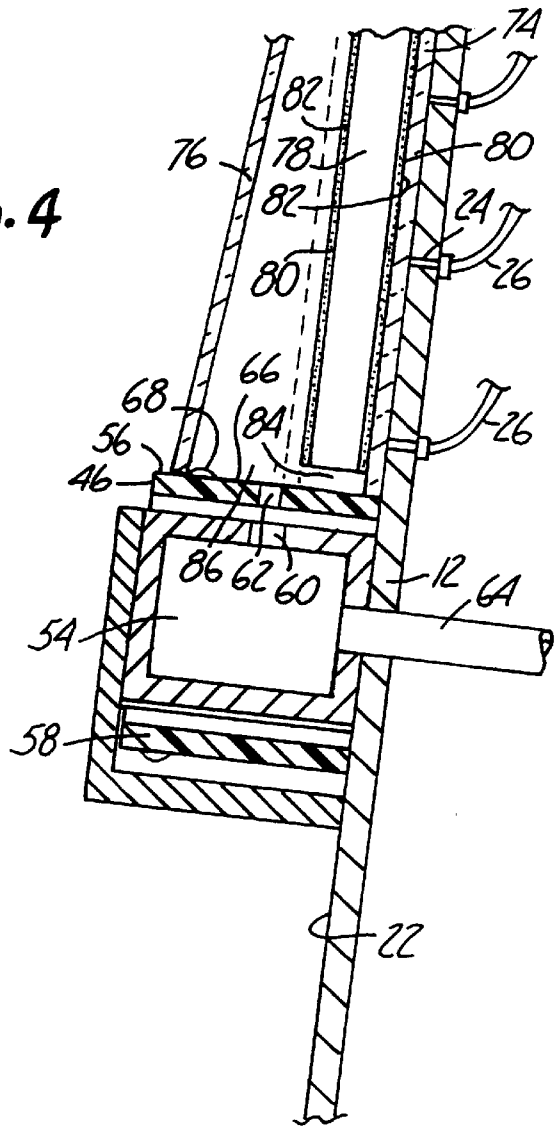
FIG. 4 is a broken away, cross sectional view showing a portion of the apparatus of FIG. 3.

The first platen 12 desirably is non-movably mounted to the framework in a generally upright position but preferably is laid back slightly at an angle of about 7° to the vertical, as shown best in FIG. 1. The platens 12, 14 may be fabricated from heavy aluminum sheeting, and may include box-like struts (not shown) on their outwardly facing sides for strength to maintain flatness of their confronting surfaces 22. A series of perforations 24 is formed in the platen 12 to admit air under pressure through its surface 22 and through which an air/insulating gas mixture may be withdrawn. Desirably, each perforation includes its own supply tube 26, as shown in FIG. 4, the tubes 26 communicating via a bidirectional control valve with a manifold enabling air to enter the enclosure through the perforations 24 to "float" the glass units as they move across the surface 22 or to exhaust the air/insulating gas mixture from the enclosure.

The second platen 14 is generally rectangular in shape to match the shape of the platen 12, and includes, at its comers, bearing blocks 28 with internally threaded apertures to receive elongated screw drive members 30, the ends of which are journaled into frame-mounted blocks 32 and are driven by an electric motor 34. The elongated screw drive members are geared together through gear boxes 35 arranged in an "H" configuration so as to rotate at precisely the same rate and thus maintain parallelism between the platens 14 and 12 as the platen 14 moves toward and away from the platen 12. The gearboxes are sized to handle the loads that are encountered while simultaneously rapidly moving the platen 14.

Figure 3:
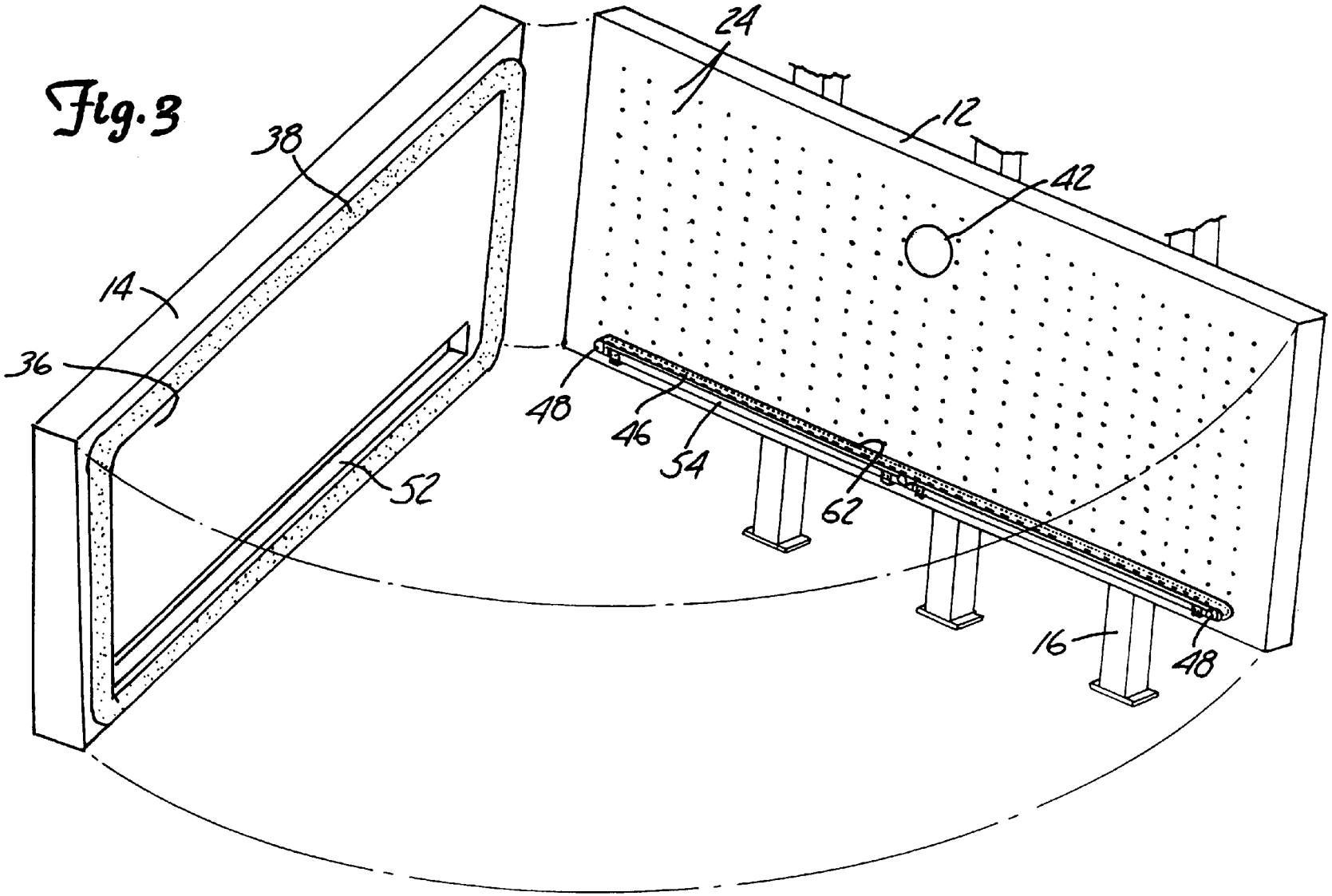
FIG. 3 is an exploded, largely schematic perspective view showing confronting faces of platens employed in the apparatus of FIGS. 1 and 2.
Figure 5:
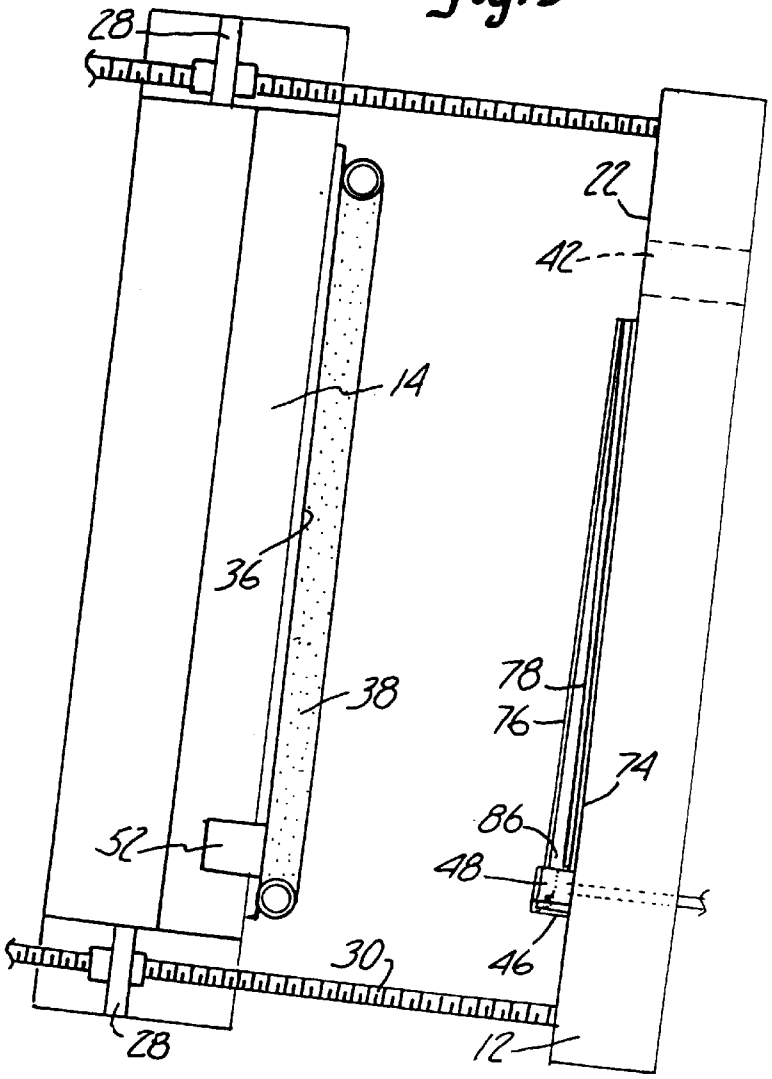
FIGS. 5, 6 and 7 are schematic views of an apparatus of the invention illustrating different stages in its use for replacing air with an insulating gas.
Figure 7:
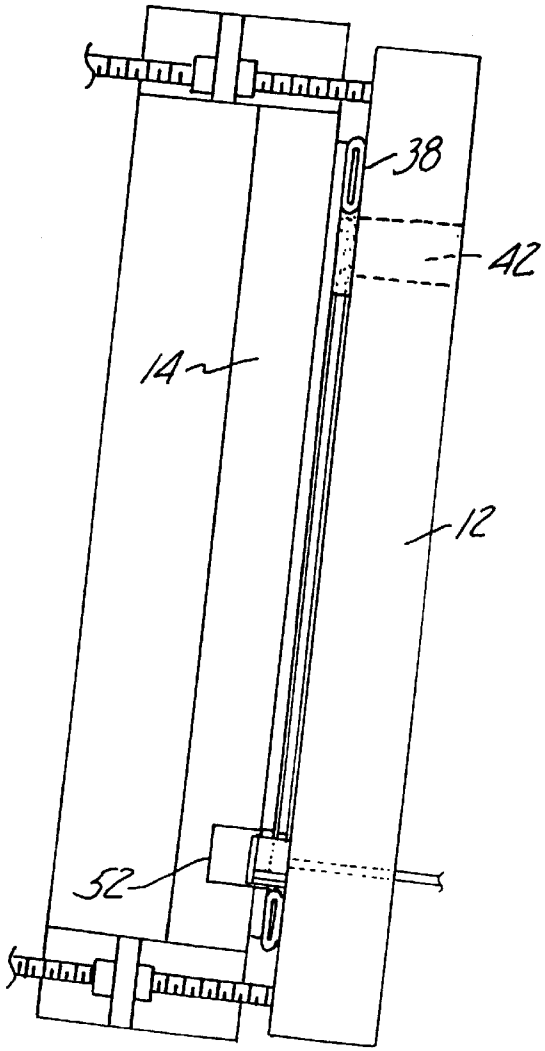

The platen 14 has a surface 36 that confronts the front surface 22 of the platen 12. Shown at 38 is a compressible, resilient seal 38 attached to the platen surface 36 adjacent the edges of the platen 14, the seal extending entirely around the periphery of the platen as shown best in FIG. 3. The peripheral seal may be adhered or otherwise attached to the surface 36, and preferably is formed of a resilient, tubular material such as polyurethane or rubber. As thus positioned, the seal comes into contact with and seals against the front surface 22 of the platen 12 as the platen 14 is moved toward the platen 12, the seal and the confronting surfaces of the platens defining an enclosure 40. The seal may be hollow, as depicted in the drawing, and has external apertures (not shown) for venting air or other gas within the seal when the seal is compressed as shown in FIG. 7; The hollow seal is sufficiently large so that, in use, it is not compressed by more than 50% and thus does not take on a significant permanent deformation or compression set due to substantial deformation of the seal.

In addition to the perforations 24 formed in the front surface of the platen 22, this platen additionally has an exhaust port 42 desirably formed approximately midway between its vertical edges and adjacent its upper edge, the port being positioned to communicate with the enclosure 40 defined by the seal 38. The exhaust port is coupled to an electrically driven exhaust blower 44 which can be controlled using a butterfly damper, by being turned on and off, or through the use of a high speed poppet control valve. Near its lower edge, the platen 12 includes a conveyor comprising an endless conveyor belt 46 trained at its ends about end rollers 48 located adjacent but spaced from the side edges of the platen 12, the rollers 48 and conveyor belt 46 being positioned so as to lie within the sealed enclosure 40 when the seal 38 seals against the platen 12. The rollers 48 may be journaled through the platen 12, as shown in FIG. 1, and may be driven by an electric motor 50 mounted to the framework at the rear of the platen 12. The platen 14 may have an elongated recess 52 adjacent its lower edge, as shown best in FIG. 3, to accommodate the conveyor belt and rollers when the platens are brought together as shown in FIG. 7.

A horizontally elongated gas manifold 54, as shown best in FIG. 4, is provided between the upper and lower runs 56, 58 of the conveyor belt 46, the manifold comprising an elongated tube having a generally rectangular cross section and containing, in its upper surface, a series of slots 60. The conveyor belt 46 also includes a series of perforations 62 positioned to come into generally vertical alignment with the slots 60. The interior of the manifold 54 communicates by means of one or more tubes 64 with a source (not shown) of argon or other insulating gas under pressure so that argon admitted to the manifold 54 is jetted upwardly through the slots 60 and perforations 62 into the interpane space. The surface 66 of the conveyor belt may, if desired, include a gently rounded elongated rib 68 to help support the outwardly spaced bottom edge of a second pane of a two-pane glass unit.

FIG. 2 depicts a partially assembled glass unit 70 that has been assembled in the manual fabrication station 18 upstream from the apparatus 10, this figure depicting the glass unit being supported on an upstream conveyor belt 72 which conveys the glass units onto the conveyor belt 46. As shown best in FIG. 4, the glass unit includes a first pane 74, a second glass pane 76, and an internal spacer 78. A thin sealant layer 80 is applied to each of the flat sides 82 of the spacer, and adheres the spacer to the peripheral edge portion of the first glass pane 74. Note, in FIG. 4, that the spacer 78 does not extend all the way to the edges of the glass panes 74, 76, there being a small space 84 between the spacer and the bottom edge of the panes. The bottom edges of the panes are supported by the upper surface 66 of the conveyor belt.

Once the partially assembled glass unit, or series of units, has been conveyed by the conveyor belt 46 between the platens 12, 14, the screw drive utilizing the elongated screw members 30 is energized and the platen 14 is moved toward the platen 12 until the resilient, compressible seal 38 contacts and presses against the platen 12 to seal the enclosure 40 and the lower edge of the glass pane 76 has come into contact with the surface 36 of the platen 14 and has been moved slightly toward the other pane 78 to provide the bottom gap 86 with a predetermined width. During conveyance of the glass units by the conveyor belt 46, air under pressure is admitted through the tubes 26 and perforations 24 to form a cushion of air between the surface 22 of the platen 12 and the adjacent pane surface, enabling that surface of the glass sheet 74 to slide readily across the surface 22.

Figure 10:
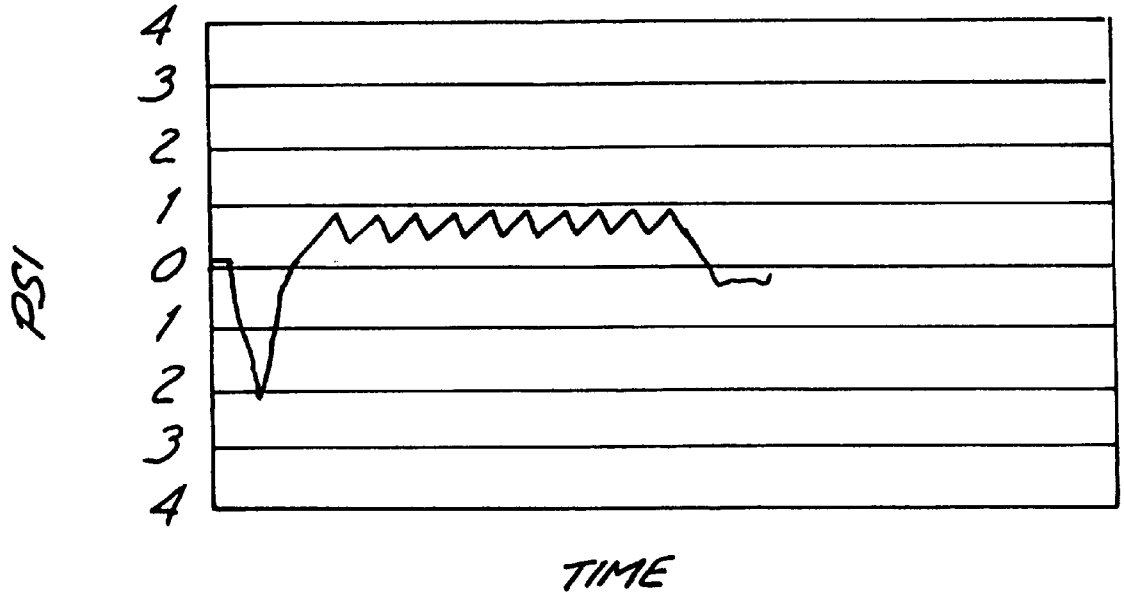
FIG. 10 is a graphical representation of pressure within an apparatus of the invention as a function of time during a single gas filling cycle.

At this point, a vacuum is pulled both within the tubes 26 (thereby anchoring the glass pane 74 to the platen surface 22) and through the duct 42. As shown in FIG. 10, the pressure within the enclosure is quickly reduced by about 2 psi. The exhaust port 42 is then dampered or valved shut, and argon is admitted under pressure into the manifold 54, the argon jetting upwardly through the slots and perforations 60, 62 and into the bottom gap 86 between the pane 76 and the spacer 80. The flow of argon is turbulent to cause rapid mixing with air in the interpane space. When pressure in the enclosure has reached approximately 0.7 psi (above atmospheric), the exhaust port is again dampered open. In the embodiment described, the flow of argon continues uninterruptedly, but the exhaust port is dampered open and shut to cycle the pressure within the enclosure between about 0.7 psi and 0.5 psi.

When the concentration of argon within the enclosure has reached the desired level—customarily about 97% —the exhaust port is closed and further evacuation of the enclosure takes place through the perforations 24 in the platen 12, the flow of argon and also evacuation ceasing as the pressure within the enclosure steadies at a predetermined level slightly below atmospheric. The screw drive members 30 are again energized to move the platen 14 further toward the platen 12, that is, from the position shown in FIG. 6 to the position shown in FIG. 7. The compressible seal 38 is further compressed, as illustrated, and the second glass pane 76 is moved into contact with the sealant 80 on the confronting surface of the spacer 78. During this maneuver, the bottom edge of the pane 76 slides across the upper supporting surface of the conveyor belt. Once the interpane space has been sealed, as shown in FIG. 7; air is readmitted to the perforations 24, and the elongated screw drive members 30 are again energized, this time in the opposite direction to draw the platen 14 away from the platen 12. When the platen 14 has moved far enough so that the sealed glass units can clear the seal 38, the conveyor belt is again energized to draw the sealed insulating glass units to the left in FIG. 2 and onto the conveyor belt 88 of the takeaway station 20. Simultaneously, the conveyor belt 72 is energized to bring another series of partially assembled insulating glass units between the platens 12 and 14, and the procedure is repeated.

As illustrated in FIG. 2, the manual fabrication station 18 and takeaway station 20 both include conveyor belts that are aligned with the conveyor belt 46 of the gas exchange apparatus 10, and each of these stations 18, 20 includes a backboard having a series of rollers against which the confronting sheet of the first glass pane of each unit can roll easily as it is conveyed from station to station.

Figure 6:
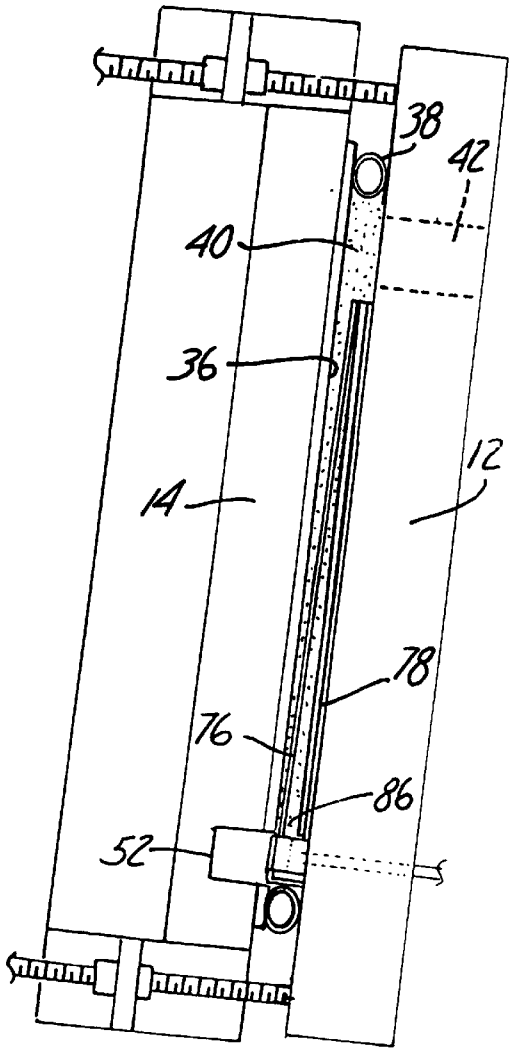

As thus described, the method of the invention involves the following timed stages:

a. From a first, open position in which completed glass units are conveyed outwardly and new, partially assembled units are conveyed between the platens, to the time that the platen 14 closes to a second position as shown in FIG. 6:—7 seconds.

b. Removal of sufficient air through the exhaust system to reduce pressure in the enclosure to a vacuum of about 2 psi:—2 seconds c. Admitting argon gas to the enclosure on a continuous basis, cycling the exhaust system until the desired argon concentration is reached, and reducing pressure to slightly less than atmospheric:—8 seconds d. Moving the platen 14 to a third position as shown in FIG. 7, thereby sealing the glass pane 76 to the spacer:—5 seconds e. Admitting air through the perforations 24 and withdrawing the platen 14 a sufficient distance to enable the now completed units to be conveyed outwardly:—4 seconds Total: 26 seconds In the foregoing example, a small vacuum was initially drawn within the enclosure, and while argon was continuously charged to the enclosure in turbulent flow, the resulting argon gas mixture was exhausted from the enclosure in a series of intermittent steps. If desired, the flow rate of argon/air mixture from within the enclosure can be varied so that instead of employing a saw-toothed pattern as shown in FIG. 10, the pressure within the enclosure can be maintained fairly constant during the gas exchange procedure. Also, the admission of argon and exhausting of the resulting argon/air mixture may be varied as desired. For example, the enclosure may be subjected to cycles between fairly deep vacuums and fairly substantial pressures. If desired, the entire gas exchange may be conducted at a super atmospheric pressure or at a sub-atmospheric pressure. By restraining variations in pressure within the enclosure to a narrow range, e.g., within about 5 psi from atmospheric and preferably within about 2 psi from atmospheric, substantial stresses on the platens due to pneumatic loading are avoided, and this is the preferred embodiment. Moreover, cycling of the pressure within the compartment in the manner described above in connection with the saw-toothed lines in FIG. 10 enables the apparatus to make use of inexpensive gas regulating systems in that the exhaust system can merely be valved or dampered on and off.

Referring again to FIG. 2, once the sealed glass units are conveyed out of the apparatus by the takeaway station 20, the conveyor belt 88 of this station may be halted and the backboard 90 of the takeaway station may be pivoted downwardly into a horizontal position as shown by the arrow 92, whereupon for the rest of the manufacturing process, the series of glass units may travel in a horizontal plane. From the gas exchange apparatus 10, the series of glass units may pass between the horizontally extending, vertically spaced platens of a press, the platens and platen-moving mechanism of which may be substantially identical to that shown in FIG. 2. The platens are brought toward one another using commonly driven geared elongated screw drive members to press the glass panes together so as to cause the sealant layers 80 to thin somewhat, the pressure within the interpane space rising slightly to atmospheric pressure as the glass unit is pressed to its desired thickness.

Figure 8:
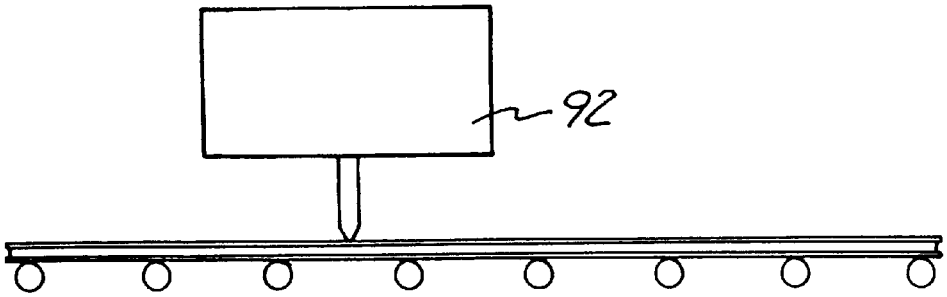
FIG. 8 is a broken away side view, largely schematic, of a measuring station of the invention in which variations in the thickness of the interpane space of a completed insulated glass unit is detected.
Figure 9:
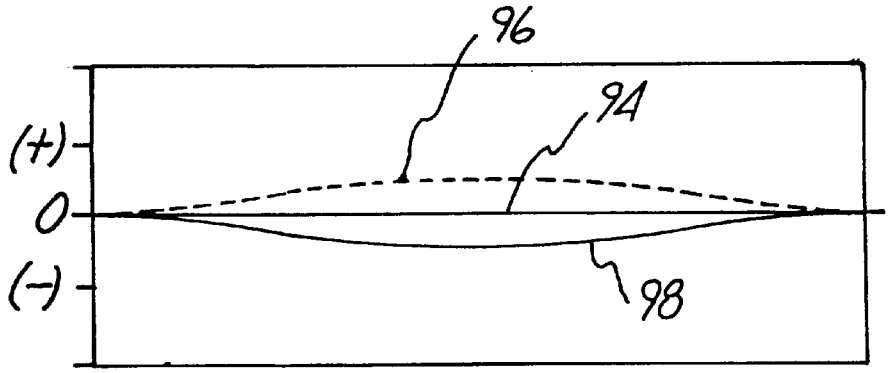
FIG. 9 is a graph illustrating outputs from the measuring device of FIG. 8.

From the pressing station, the glass panes travel beneath a known ultrasonic thickness measuring device such as that shown in FIG. 8 as 92, this device generating a signal representative of the overall thickness of the unit at its center point from the leading edge of the unit to the trailing edge. In the graph of FIG. 9, the abscissa represents the length from the leading to the trailing edge of each glass unit and the ordinate represents thickness. Line 94 represents the desired thickness. Line 96 represents a situation in which the interpane space has been slightly overfilled with argon and, as a result, the panes bulge slightly. Line 98 represents a slight cupping of the panes, indicating that either slightly too little argon was provided in the interpane space, or, more likely, that there is an imperfection in the seal 80 sealing the spacer to the panes and enabling gas to leak out of the interpane space. Tolerance limits are set up on either side of the set point 94 such that if a glass unit that is being measured bows or cups beyond the tolerance limits, a signal—commonly audible—is given and the offending glass unit may be removed from the line. If it is found that glass units continuously and reproducibly bulge, then adjustments in the final argon pressure within the enclosure of the gas exchange unit may be made. If a run of many glass units of the same size is being manufactured, the signal from the measuring device may be fed back directly to the gas filling system to adjust the final argon pressure. It has been found, however, that different sizes of glass units require different, predetermined sub-atmospheric pressures of argon in the glass units as they leave the glass exchange apparatus.

Thus, the present invention provides a gas exchange apparatus that enables the exchange of argon or other insulating gas for air within a partially assembled glass unit, which can accommodate a series of glass units of different shapes and sizes, and which performs this procedure rapidly and reproducibly.

While a preferred embodiment of the present invention has been described, it should be understood that various changes, adaptations and modifications may be made therein without departing from the spirit of the invention and the scope of the appended claims.

What is claimed is:

1. Method for replacing air with an insulating gas during manufacture of an insulated glass article having two parallel panes and a peripheral spacer between the panes and defining an interpane space, the method comprising spacing a lower edge of one pane from said spacer to provide a bottom gap permitting communication with the interpane space; positioning the insulated glass article within an enclosure and sealing the enclosure about the insulated glass article; turbulently flowing an insulating gas upwardly into said gap to turbulently mix with said air and exhausting insulating gas/air mixture from the enclosure until the concentration of insulating gas within the enclosure reaches a predetermined value; and closing the lower edge of the glass pane against the spacer to seal the interpane space.

2. The method of claim 1 including the step of drawing a partial vacuum within the enclosure before flowing insulating gas within the interpane space.

3. The method of claim 1 or claim 2 wherein said insulating gas is emitted within the enclosure under superatmospheric pressure.

4. The method of claim 1 including the step of adjusting the final pressure within the interpane space to a level slightly below atmospheric pressure before closing the lower edge of the glass pane against the spacer to seal the interpane space.

5. The method of claim 4 including the step of measuring the thickness of the resulting insulating glass unit from its leading to its trailing edge to detect any bulging or cupping of the glass unit, and adjusting said final pressure so as to reduce any such bulging or cupping.

6. The method of claim 1 including the step of supporting said partially assembled glass unit within said enclosure upon a perforated conveyor belt contained in said enclosure, and wherein said insulating is jetted upwardly through said perforations into said bottom gap in said glass unit.

7. Method for replacing air with an insulating gas during manufacture of an insulated glass article having two parallel panes and a peripheral spacer between the panes and defining an interpane space, the method comprising spacing a lower edge of one pane from said spacer to provide a bottom gap permitting communication with the interpane space; conveying the insulated glass article within an enclosure; turbulently flowing an insulating gas upwardly into said gap to turbulently mix with said air, simultaneously exhausting insulating gas/air mixture from the enclosure until the concentration of insulating gas within the enclosure reaches a predetermined value; closing the lower edge of the glass pane against the spacer to seal the interpane space; measuring the thickness of the resulting insulating glass unit from its leading to its trailing edge to detect any bulging or cupping of the glass unit; and adjusting said final pressure so as to reduce any such bulging or cupping in subsequent units.

8. A method for replacing air with an insulating gas during manufacture of an insulated glass article having two parallel panes and a peripheral spacer between the panes and defining an interpane space, the method comprising spacing a lower edge of one pane from said spacer to provide a bottom gap permitting communication with the interpane space; positioning the insulated glass article between a first platen carrying a peripheral seal, and a second platen; sealing the peripheral resilient seal against the second platen to form a sealed enclosure; turbulently flowing an insulating gas upwardly into said gap to turbulently mix with said air and intermittently exhausting insulating gas/air mixture from the enclosure such that the pressure within the enclosure cycles in a predetermined range until the concentration of insulating gas within the enclosure reaches a predetermined value; and closing the lower edge of the glass pane against the spacer to seal the interpane space.

9. A method for replacing air with an insulating gas during manufacture of an insulated glass article having two parallel panes and a peripheral spacer between the panes and defining an interpane space, the method comprising spacing a lower edge of one pane from said spacer to provide a bottom gap permitting communication with the interpane space; conveying the insulated glass article within an enclosure; turbulently flowing an insulating gas upwardly into said gap to turbulently mix with said air, and intermittently exhausting insulating gas/air mixture from the enclosure such that the pressure within the enclosure cycles in a predetermined range, until the concentration of insulating gas within the enclosure reaches a predetermined value; and closing the lower edge of the glass pane against the spacer to seal the interpane space.

10. A method for replacing air with an insulating gas during manufacture of an insulated glass article having two parallel panes and a peripheral spacer between the panes and defining an interpane space, the method comprising spacing a lower edge of one pane from said spacer to provide a bottom gap permitting communication with the interpane space; positioning the insulated glass article between two platens and sealing the platens against one another to define a sealed enclosure within which the insulated glass article is received; turbulently flowing an insulating gas upwardly into said gap to turbulently mix with said air and exhausting insulating gas/air mixture from the enclosure until the concentration of insulating gas within the enclosure reaches a predetermined value; and closing the lower edge of the glass pane against the spacer to seal the interpane space.

11. The method of claim 10 wherein at least one of said platens has a face bearing a plurality of spaced-apart perforations, at least a portion of the insulating gas/air mixture exhausted from the enclosure being exhausted through said perforations.

12. The method of claim 11 further comprising delivering air through the spaced-apart perforations to form a cushion of air between the platen bearing said perforations and an adjacent surface of one of said panes.

13. The method of claim 12 wherein said enclosure is defined between first and second platens, the first platen carrying a peripheral seal, the method further comprising conveying the panes and spacer between the first and second platens then urging the peripheral seal against the second platen to seal the insulated glass article within the enclosure.

14. The method of claim 12 further comprising cycling pressure within the enclosure by intermittently exhausting insulating gas/air mixture from the enclosure while flowing insulating gas upwardly.

15. The method of claim 12 wherein at least one of said platens has a face bearing a plurality of spaced-apart perforations, at least a portion of the insulating gas/air mixture exhausted from the enclosure being exhausted through said perforations.

16. The method of claim 15 further comprising delivering air through the spaced-apart perforations to form a cushion of air between the platen bearing said perforations and an adjacent surface of one of said panes.

17. A method for manufacturing of an insulated glass article having two parallel panes and a peripheral spacer between the panes and defining an interpane space, the method comprising spacing a lower edge of one pane from said spacer to provide a bottom gap permitting communication with the interpane space; sealing the insulated glass article within an enclosure initially filled with air; turbulently flowing an insulating gas upwardly into said gap to turbulently mix with said air until the concentration of insulating gas within the enclosure reaches a predetermined value; and closing the lower edge of the glass pane against the spacer to seal the interpane space.

* * * * *

UNITED STATES PATENT AND TRADEMARK OFFICE

CERTIFICATE OF CORRECTION

PATENT NO. : 6,158,483
APPLICATION NO. : 09/286349
DATED : December 12, 2000
INVENTOR(S) : Paul Trpkovski It is certified that error appears in the above-identified patent and that said Letters Patent is hereby corrected as shown below:

First Page:

Under "Related U.S. Application Data,"

Reads:

"[62] Division of application No. 08/957,532, Oct. 24, 1997, Pat. No. 5,957,532."

Should read:

-- [62] Division of application No. 08/957,532, Oct. 24, 1997, Pat. No. 5,957,169 --.

Signed and Sealed this

Seventeenth Day of April, 2007

JON W. DUDAS
*Director of the United States Patent and Trademark Office*